United States Patent [19]

Cardwell et al.

[11] 4,093,698

[45] June 6, 1978

[54] PROCESS FOR THE SIMULTANEOUS EXTRACTION OF METAL VALUES FROM MANGANESE NODULES

[75] Inventors: Paul H. Cardwell, Zanoni; William S. Kane, Wicomico, both of Va.

[73] Assignee: Deepsea Ventures, Inc., Gloucester Point, Va.

[21] Appl. No.: 733,087

[22] Filed: Oct. 18, 1976

[51] Int. Cl.[2] ..... C01G 3/14; C01G 51/12; C01G 53/12

[52] U.S. Cl. ..... 423/24; 423/32; 423/50; 423/139; 423/143; 423/144; 423/150; 423/DIG. 4

[58] Field of Search ..... 423/24, 32, 33, 49, 423/50, 56, 63, 139, 143, 144, 150, 419, 55; 75/21, 80, 103, 108, 117, 119, 101 BE

[56] References Cited

U.S. PATENT DOCUMENTS

| | | | |
|---|---|---|---|
| 2,621,107 | 12/1952 | Dean et al. | 423/50 |
| 2,724,645 | 11/1955 | Stringham | 423/49 |
| 2,775,508 | 12/1956 | Thomsen | 423/419 |
| 2,879,137 | 3/1959 | Bare et al. | 423/419 |
| 3,471,285 | 10/1969 | Rolf | 75/80 |
| 3,734,715 | 5/1973 | Redman | 75/21 |
| 3,751,554 | 8/1973 | Bare et al. | 423/144 |
| 3,761,250 | 9/1973 | Weir et al. | 75/103 |
| 3,907,966 | 9/1975 | Skarbo | 75/101 BE |
| 3,988,224 | 10/1976 | Barriere et al. | 423/50 |

*Primary Examiner*—O. R. Vertiz
*Assistant Examiner*—Brian E. Hearn
*Attorney, Agent, or Firm*—Barry G. Magidoff

[57] ABSTRACT

This invention provides a leaching procedure for manganese nodules for obtaining directly from a leaching stage all of the metal values, including manganese, utilizing an ammoniacal aqueous solution. The manganese nodules are reduced and then leached utilizing an ammoniated solution of an ammonium salt comprising at least about 150 grams per liter of ammonium ion and at least 0.83 Normal in the anion, other than hydroxyl. The resultant leach solution comprises the dissolved manganese, nickel, cobalt and copper values from the nodule ore, and can subsequently be treated, as by liquid ion exchange, to separate out the individual metal values.

16 Claims, 1 Drawing Figure

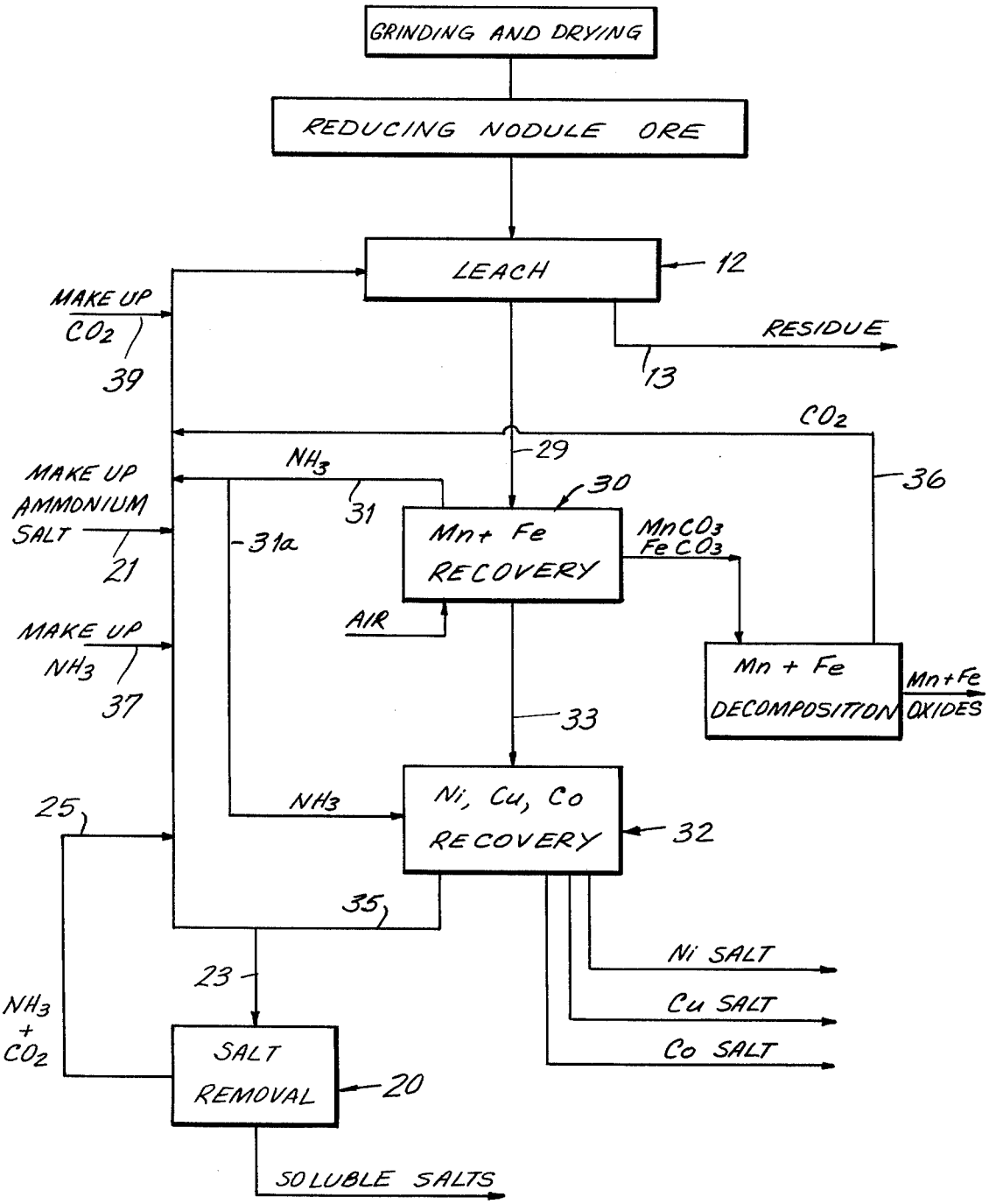
GRINDING AND DRYING
REDUCING NODULE ORE
LEACH
12
MAKE UP
CO2
39
RESIDUE
13
CO2
29
36
MAKE UP
AMMONIUM
SALT
21
NH3
31
30
31a
Mn+ Fe
RECOVERY
MnCO3
FeCO3
AIR
MAKE UP
NH3
37
Mn + Fe
DECOMPOSITION
Mn+Fe
OXIDES
33
25
NH3
Ni, Cu, Co
RECOVERY
32
35
23
Ni SALT
Cu SALT
Co SALT
NH3
+
CO2
SALT
REMOVAL
20
SOLUBLE SALTS

PROCESS FOR THE SIMULTANEOUS EXTRACTION OF METAL VALUES FROM MANGANESE NODULES

It is not a common situation to obtain a relatively valuable non-ferrous metal such as nickel, cobalt, copper and zinc together with a relatively large proportion of manganese and a significant quantity of iron. A relatively untapped source of high-quality manganiferous ore, however, is a material which is found on the ocean floor and has come to be known as ocean floor nodule ore, or manganese nodule ore.

With the increased awareness on the part of both the public and the metals industry of the ecological dangers that can arise from continued surface mining of minerals required for most ores mined from the land, as well as the recent diminution in the availability of valuable industrial ores, the mining industry has become interested within the last several years in the mining of minerals from the sea. This has been an extremely elusive target up to the present. One method of obtaining such minerals has been the dredging of the deep ocean floor to obtain an ore which has variously become known as ocean floor nodule ores, manganese nodules or merely nodules. Such minerals can be merely scooped up from the top surface of the ocean floor without requiring a rending of the earth's surface.

The nodule ore was first collected during the first part of the 1870's. Deposits of this ore are found as nodules, lying on the surface of the soft sea floor, as large slabs on the ocean floor, or as replacement fillings in calcareous debris and other animal remains. They have been studied by many workers in an attempt to determine their precise composition, and then to decipher ways to wrest from their peculiar structure the valuable metals contained therein. It is presently believed that these nodules are actually creations of the sea; they are somehow grown, generally in the form of the metal oxides, from metal values which are dissolved in sea water.

The metal values of the nodules are almost exclusively in the form of oxides and moreover are present in extremely peculiar physical configuration. The physical and chemical structure of the nodules are believed to be a direct result of the conditions under which they were created and to which they have been exposed since their creation. First, nodule ore has never been exposed to temperatures other than those at the bottom of the ocean at the location at which they were formed. The nodule ores have an extremely large surface area, a porosity often greater than 50%, and are relatively chemically reactive ores. The solid structure of the nodules is extremely complex, seemingly formed of many crystalites, but without any recognizable overall crystalline pattern or structure. The nodules are formed basically of what appears to be an extremely complex arrangement, or matrix, of iron and manganese oxides: tiny grains of each oxide of a size and type which are substantially impossible to separate by presently available physical means. These iron and manganese oxides form the basic structure within which other metal values are retained, in what is believed to be at least partially a result of a substitution mechanism. These other metal values include, as the major ingredient, nickel, copper and cobalt, and in addition, chromium, zinc, tin, vanadium and other metals, including the rare metals, silver and gold.

In addition to the metal oxides, described above, there is also present a large quantity of silt, or gangue material, intimately admixed with the nodule ore. This silt, or gangue, is sand and clay, and includes the usual oxides of silicon and aluminum and varying proportions of some carbonates, especially calcium carbonate.

The precise chemical composition, as well as the physical structure, of the nodules vary somewhat depending upon their location in the ocean. Variation is perhaps caused by differences in temperature in various places, and at different depths, differences in the solute composition of sea water, perhaps caused by the pressure variations at different depths and the composition of adjacent land areas, variations in the amount of oxygen which is present in the water in different locations, and perhaps other variables not readily apparent to observers. Generally, however, in almost all cases, the metals which are present in primary proportions are manganese and iron, and the predominant secondary metals are generally nickel, copper and cobalt. A detailed analysis of a variety of different nodule ores can be found in an article entitled "The Geochemistry of Manganese Nodules and Associated Deposits From the Pacific and Indian Oceans" by Croonan and Tooms, in *Deepsea Research* (1969), Volume 16, pages 335 - 359, Pergamon Press (Great Britain).

As a general rule, the nodule ores can be considered as containing the following metal content ranges, derived on a fully dry basis.

| | Percent |
|---|---|
| Copper | 0.8 - 1.8 |
| Nickel | 1.0 - 2.0 |
| Cobalt | 0.1 - 0.5 |
| Manganese | 10.0 - 40.0 |
| Iron | 4.0 - 25.0 |

Because of the peculiar and intricate crystal structure of the ocean floor nodules, many of the common refining techniques used for the refining of land ores are not generally suited for the nodules. Most especially, because of the great value attached to the nickel and copper values in the manganese nodules, and the relatively large amounts of manganese found in these ores, special procedures are needed, which are not relevant to terrestrial ores, for the refining of these materials.

Among the procedures is included the reduction of pellets prepared from manganese deepsea nodules, to form metallic copper, nickel and cobalt, within the pellets, followed by leaching with an ammoniacal ammonium salt solution to obtain the copper, nickel and cobalt salts in solution without dissolving any manganese or iron. The leaching is carried out in the presence of aeration, see U.S. Pat. Nos. 3,788,841 and 3,741,554.

Nodule ores have also been treated by two-phase leaching utilizing ammoniated ammonium salt solutions, wherein the temperatures vary, to initially extract copper under milder, room temperature conditions, and subsequently to extract nickel under higher temperatures (U.S. Pat. No. 3,736,125). A selective reduction of the manganese nodules permits the selective leaching of copper, nickel, cobalt and molybdenum, without the leaching of manganese, according to U.S. Pat. No. 3,734,715, while the partial reduction of a nodule ore charge, when utilizing an ammonia solution also containing manganous ions, permits the leaching of copper, nickel, cobalt and molybdenum (U.S. Pat. No. 3,723,095).

In a somewhat different direction, manganese has been extracted from terrestrial manganiferous ores, which have not contained cobalt, copper and nickel, utilizing acidic ammonium salts, such as ammonium sulfate, see "*Review of Proposed Processes for Recovering Manganese From United States Resources, Part 2-Chloride and Fixed Nitrogen Processes*", Bureau of Mines, Information Circular No. 8160 (1963, U.S. Dept. of Interior), pages 26 - 28.

One problem which has been met when attempting to apply the processes utilized by the prior art for terrestial ores is the difficulty of obtaining all of the metal values present in the ocean floor nodule ore including the manganese value and the nickel, copper and cobalt values by a single leaching utilizing a single leaching solution. The relatively high proportion of manganese value present in the ocean floor nodule ore makes the ore generally unsuitable for extraction of manganese utilizing the prior art techniques of leaching for cobalt, copper and nickel utilizing ammoniated ammonium salts. Similarly, cobalt, copper and nickel values have been found to be not readily leached, even from a reduced nodule ore, utilizing an acidic ammonium salt solution. It is sometimes desirable to utilize only a single leaching solution so as to obtain a pregnant leach solution comprising all of the metal values in the nodule ore. The separation of the individual metal values can then take place by separation from the pregnant leach solution, by means peculiarly designed for the specific metal values present therein. It is, accordingly, an object of the present invention to provide a procedure for obtaining all of the major valuable metal values present in ocean floor nodule ore utilizing a single leaching solution to obtain a pregnant leach solution comprising the valuable nickel, copper and cobalt values as well as the desirable manganese value. It is further an object of this invention to provide a continuous process for obtaining the metal values wherein the leaching solution can be recovered and recycled for future use and the individual metal values separated therefrom in separate streams.

In accordance with the present invention, there is provided a process for leaching substantially all of the valuable metal values from a manganese nodule ore, the ore comprising primary proportions of manganese and iron and secondary proportions of nickel, copper and cobalt. Most preferably, the ore contains a manganese: iron ratio of at least about 5:1 and optimally about 6:1, and a total proportion of copper, nickel and cobalt of at least about 1.5% by weight of the total ore. The process comprises the steps of: (a) reducing the manganese nodule ore; (b) leaching the reduced ore with an aqueous ammoniated solution of an ammonium salt to dissolve out the manganese, copper, cobalt and nickel values from the ore so as to obtain a pregnant aqueous leach solution comprising dissolved manganese salt, cobalt salt, copper salt, and nickel salt, and a solid final residue, wherein the reduced ore is permitted to be oxidized prior to the completion of the releaching so that the cobalt, nickel and copper values are in a soluble and leachable condition. In a preferred embodiment of this process, the pregnant leach solution is then further treated to separate the individual metal values by initially removing the manganese and any iron values therefrom, by causing the precipitation of insoluble compounds thereof, separating the manganese and iron precipitates from the remaining aqueous solution and treating the remaining aqueous solution with a liquid ion exchange agent, so as to separate the remaining cobalt, nickel and copper values into separate solutions thereof, by selective extraction.

In accordance with this process, the nodule ore is preferably initially dried and the reduction carried out under anhydrous conditions. The drying can be carried out in the same or a separate stage, at temperatures substantially below the reduction temperatures. The drying temperatures are preferably no greater than about 250° C. and most preferably at temperatures in the range of from about 150° to about 250° C.

In order to increase the rates of drying and subsequent reduction and leaching of the nodule ore, the ore is preferably initially comminuted, as by grinding and crushing to a particle size of not greater than about 20 mesh, U.S. Sieve Scale, most preferably not greater than about 50 mesh and optimally not greater than about 100 mesh.

The dried and comminuted nodule ore is next reduced preferably at a temperature of at least about 300° C. The reduction is most easily and economically carried out by reacting the module ore with a carbonaceous or hydrogen-containing reducing agent, which is itself oxidized to either carbon dioxide or water vapor when the metal values are reduced.

The intent of this reducing step is to convert the metal values in the nodule ore into forms which are readily leachable by the ammoniated ammonium salt solutions described herein. It has been found that the nodule ore as obtained from the ocean floor, and even after drying, is not readily susceptible to leaching utilizing the ammonium salt solutions of the present invention. After reduction, however, it has been found that the metal values can be readily dissolved into an ammoniated ammonium salt solution.

The reduction to be carried out in accordance with the process of this invention should result in substantially all of the manganese originally present in the ore in the tetravalent state to be reduced to the divalent state. Concurrently with the reduction of the manganese, there must, almost of necessity, be a reduction of the nickel, cobalt and copper values present in the ore. Although it is not clear to exactly what valence state the nickel, cobalt and copper are reduced, it is generally believed that they are reduced to a state below that at which they are found in the ore. Without being limited thereto, it is believed that the copper is reduced to either the monovalent or the elemental state and the nickel and cobalt are reduced to some other state, perhaps one intermediate the common divalent and elemental states.

It has been found that any iron value will also generally be reduced to a state below that in which it is normally found, and that at least part of the iron is reduced to a state where it is not leached out together with the manganese value in accordance with the first leaching step of the present invention. This, what is in effect, limited-reduction of the iron is desirable in decreasing the iron in the solution so as to minimize the problems of subsequent separation of iron from manganese in the leach solution. Generally, the relative proportion of manganese and iron in the nodule ore is somewhat too rich in iron to obtain a valuable commercial produce if all the iron were to be leached out in the same proportion as the manganese.

The exact mechanism by which the various metal values are reduced or oxidized, and even the valence states to which they are reduced or oxidized, have not been precisely determined, but need not be known for the satisfactory carrying out or regulation of the process of the present invention.

Although the scope of this invention should not be limited thereto, it is believed that generally any reducing agent which has sufficient reducing strength to reduce tetravalent manganese to divalent manganese and to reduce the other metal values in the ore can be utilized for the reducing stage of this invention. It should, of course, be noted that the reducing agent need not be a pure compound or element and that a combination of two or more reducing agents can be utilized. For example, many natural products, such as hydrogen, natural gas or coal, or manufactured gas, e.g., producer gas, contains a combination of compounds or elements at least some of which provide at least some reducing action with regard to the metal values in the nodule ore. Generally, elemental carbon in any physical state, including amorphous or graphitic carbon, or natural or semi-manufactured solid carbonaceous materials, such as coal, peat, charcoal, and coke, can be used. Oil or other organic sources can be utilized as a source for the reducing action of carbon, and any hydrocarbon can be used: aromatic, aliphatic or cycloaliphatic, or compounds having combinations of these groups, without interfering with the reducing action. Solid hydrocarbon compounds, especially the higher condensed ring aromatic materials, including most especially those derived from petroleum or other natural mineral products which are often available as by-product tars from the refining of these materials, have the highest proportion of carbon among the hydrocarbons, and, therefore, provide a desirable unit weight effectiveness as a solid reducing agent. Gaseous materials, such as carbon monoxide, alone or admixed with hydrogen, as in reformer gas, can also be readily utilized as reducing agents. As stated earlier, hydrogen itself is a strong and effective reducing agent, and, if available cheaply enough, can be used commercially.

Generally, the most efficient temperature, or temperature range, for the reduction reaction is dependent upon the reducing agent utilized. The reducing agents, which are most effective in reducing tetravalent manganese to the divalent state, and which also can reduce the other metal values present, at temperatures as low as about 300° C. in accordance with this procedure, include normally gaseous materials such as hydrogen and carbon monoxide, and synthetic mixtures thereof. Other fluid reducing agents, such as, for example, the lower, gaseous or liquid, hydrocarbons, which are somewhat less effective in reducing manganese and the other metal values, should be used at somewhat higher temperatures of at least about 500° C. Generally, the solid reducing agents, such as elemental carbon, e.g., coal, or the higher solid hydrocarbons, would be utilized at higher temperatures of at least about 550° C.

Generally, for a given reducing agent, the higher the temperature of reaction, the shorter should be the reaction time, in order to avoid over-reduction of the ore. In any event, generally, a temperature greater than about 850° C. is unnecessary and introduces difficulties in the subsequent leaching steps, so that preferably temperatures in the range of from about 350° to about 800° C. are preferred, but optimally, temperatures not greater than about 750° C. are utilized.

The reduction of the nodule ore can be carried out on a batch or a continuous basis. The time of reaction is substantially the same and is measured as "residence time", for either basis. The reduction reaction time, or residence time, is generally maintained at from about 0.5 to about 3 hours, and preferably 0.75 to about 1.75 hours.

The reduced ore is next subjected to an aqueous leaching, utilizing an aqueous solution of ammonium hydroxide, i.e. dissolved ammonia $NH_3$, and an ammonium salt. The divalent manganese value present in the reduced ore has been found to be leached together with the nickel, copper and cobalt values by the ammoniated ammonium salt solution when the ammonium salt solution contains a minimum of 150 grams per liter of total dissolved ammonium ion ($NH_4^+$) including both the salt and the ammonium hydroxide, and preferably at least about 260 grams/1 $NH_4^+$, and the concentration of the ammonium salt anion being at least about 0.83 Normal. The concentration of dissolved free ammonia, i.e., ammonium hydroxide, is preferably at least about 120 grams per liter $NH_4^+$.

It is believed that at the very high concentrations of ammonia required in accordance with the process of the present invention, a complex of the ammonia with the manganese value is formed rendering the manganese salt soluble at a pH at which it would ordinarily be insoluble. Without limiting the scope of this invention, the solution of the manganese as well as the nickel, copper and cobalt is believed to follow the following net reaction equation, utilizing manganese and ammonium carbonate as examples:

$$\text{I. } MnO + H_2O + 2NH_4^+ + CO_3^= + yNH_3 \rightarrow Mn(NH_3)y + CO_3^= + 2NH_4OH$$

The above equation is the net result of the process occurring in the dissolution of the manganese value in the manganese nodule. A substantially similar reaction is also believed to occur during the dissolution of the nickel value from nickel oxide (NiO), cobalt value from cobalt oxide (CoO) and the copper value from copper oxide (CuO).

There must be sufficient quantity of ammonia dissolved in the leaching solution to cause the solution of the desired metal values, specifically the manganese, nickel, copper and cobalt, by forming the ammonia/-metal complexes. Although the precise ratio between the ammonia and the metal ion in the complex is not known with definition, without seeking to limit the scope of this invention, it is believed that from about 3 to about 5 mols of ammonia per mol of metal should be dissolved in the leaching solution to provide the desired ammonia/metal complexes.

Although the maximum concentration of the free ammonia and ammonium salt is not crucial, it has been found that it is generally unnecessary to provide a completely saturated solution of the ammonium salt, as this will provide generally too great an excess of the salt.

A quantity of iron is also generally dissolved by the ammoniated ammonium salt leaching solution from the reduced ore residue. The iron is undesirable as it can interfere with the subsequent treatment of the leach solution to separate the desired metal values, specifically nickel, cobalt, manganese and copper, into separate streams. However, the iron can be removed together with the manganese without interfering with the commercial value of the thus separated manganese, especially if some of the iron had been reduced to a nonleachable state. The proportion of manganese-to-iron precipitated is such that a commercially valuable ferromanganese product can be obtained containing that ratio of manganese-to-iron.

A solid manganese compound, admixed with the companion iron compound, can be obtained from the leach liquid by a variety of methods, including precipitation and crystallization. This manganese and the iron value can be caused to precipitate by removing a portion of the dissolved ammonia, for example, by sparging the solution with air or nitrogen or other gas which does not interfere with the solution of the remaining metal values. Although the sparging can be carried out at temperatures as low as ambient, preferably the sparging with gas is carried out at temperatures greater than 40° C. and preferably greater than 50° C, and optimally up to about 75° C, although, generally, temperatures up to but not including boiling of the solution can be utilized, if desired. Furthermore, if desired, ammonia can be driven off by boiling the solution without sparging.

There is very little danger of causing the precipitation of any of the other desired metal values, i.e., cobalt, nickel and copper, together with the iron and manganese, as long as care is taken to insure that the sparging and/or boiling is terminated once the precipitation of the iron and manganese has ceased. The precipitation of any nickel, cobalt and copper does not occur until a substantially greater amount of the ammonia is removed than is necessary to precipitate substantially all of the manganese and iron. These manganese and iron precipitates can be readily separated from the solution by, for example, filtration.

In those situations where the original leach solution contains too high a proportion of iron to form a commercially valuable ferro-manganese product by the combined precipitation of iron and manganese compounds, it is possible to preferentially initially precipitate iron compound and then precipitate the manganese and remaining iron compound in a commercially valuable ratio. Sparging with air to preferentially remove iron can be carried out at room temperature. This results initially in the precipitation of iron, or a mixture of iron and manganese values, after which the precipitate can be separated from the remaining solution. Continued sparging at elevated temperatures is then carried out until substantially all of the remaining iron and manganese is precipitated in the more desirable ratio.

The resulting manganese-and iron-free leach solution is a relatively pure solution of the three valuable major metal values from the ore, i.e., nickel, cobalt and copper, together with a relatively smaller proportion of other valuable metal values. The relatively highly pure solution of the nickel, cobalt and copper salts can be then treated in a variety of ways to obtain the individual metal values in a pure state.

One preferred method of separating the individual nickel, cobalt and copper values from the solution is by liquid ion exchange procedures. One such liquid ion exchange procedure for separating nickel from cobalt is shown, for example, in U.S. Pat. No. 3,276,863. This procedure is especially effective when the ammonium salt is the carbonate.

In one example of such a procedure, an ammoniacal solution of nickel, cobalt and copper, is initially aerated to ensure that all of the cobalt has been oxidized to the trivalent state. This has generally been accomplished when oxidizing the iron and manganese and sparging with air at elevated temperatures. The oxidized solution is then contacted with a water-insoluble organic solution of a liquid ion exchange agent, such as an alphahydroxy oxime, or a 7-hydrocarbon-substituted-8-hydroxyquinoline. The copper value is first selectively extracted into the organic solution so that when the organic and aqueous solutions are separated, the first aqueous raffinate comprises a solution of nickel and cobalt salts, substantially free of the copper salt, and the organic solution contains copper value, substantially free of nickel and cobalt values. The cobalt and nickel can be subsequently separated by extracting the nickel from the first raffinate, utilizing the same extraction agent to form a second aqueous raffinate containing the cobalt value, substantially free from copper value, and an organic phase comprising the nickel value. The two organic phases can be stripped utilizing a weak acid solution. A more complete exposition of the various extraction agents utilized for separating copper and nickel from cobalt is shown for example, in U.S. Pat. No. 3,894,139.

Peferred examples of certain advantageous embodiments of procedures in accordance with the present invention are set forth in the accompanying drawing which is a schematic view of a flow diagram of a system for obtaining the substantially complete separations of the metal values found in manganese nodule ores, utilizing ammonium carbonate as the leaching solution.

In the drawing, and in the following verbal description of the process, the elements of the apparatus and the general features of the procedure are shown and described in highly simplified form, and generally in an essentially symbolic manner. Appropriate structural details and parameters for actual operation are available and known to those skilled in the art and are not set forth in the description or the drawings, but are included, where necessary, in the specific examples set forth below. Generally, all process vessels and flow conduits can be of conventional construction and materials suitable for the particular reagents and products to be contained in accordance with the present process.

Referring to the drawing, manganese nodule ore is initially dried and then ground to a particle size preferably not greater than about 20 mesh and optimally not greater than about 50 mesh, U.S. Sieve Sizes. The dried ore particles are then admixed with a reducing agent, for example a solid carbon-containing material such as coke or coal, or a gaseous material, such as carbon monoxide, hydrogen, or a mixture thereof, at a temperature of at least about 350° C., in order to reduce the tetravalent manganese to divalent manganese and to reduce the cobalt, copper and nickel values present in the ore. The reduction is carried out until the ore is in a state at which substantially all of the aforesaid four metal values can be leached from the reduced ore utilizing an ammoniated ammonium salt solution with aeration.

The reduced nodules are removed from the reduction reactor and permitted to cool to below 100° C., and then admixed with a leaching solution comprising the ammoniated aqueous solution of an ammonium salt. The leaching can be carried out in a single large tank reactor or in a plurality of smaller reactors, preferably wherein the aqueous solution and the solid are contacted counter-concurrently in a series of stages. Both of these situations, as well as any other method for contacting the leaching liquid with reduced nodule ore, are encompassed within the portion indicated by the numeral 12. In any event, air, or other oxygen-containing oxidizing gas is passed preferably through the leaching solution while it is in contact with the ore solids in order to ensure that substantially all of the nickel, cobalt and copper in the ore solids have been oxidized to the soluble valence level. In a multistage contact procedure, the air can be passed into the solution only in the last, or the last several, stages, if desired. The ore residue is separated from the leach solution and can be discarded via conduit means 13. The leach solution is passed from the leaching stage through conduit 29 to the manganese and iron recovery stage 30, where the pregnant leach liquid is contacted with a sparge gas, for example, air or nitrogen, to sparge out ammonia, which is passed overhead through a conduit 31 to a recycle conduit 35. Upon completion of the precipitation of the iron and manganese, the leach liquid is passed out of contact with the sparge gas, and passed to the nickel, copper and cobalt recovery stage 32 via conduit 33. The precipitated iron and manganese salts, upon separation from the remaining leach liquid, can then be decomposed at elevated temperatures, especially where the manganese and iron compounds are the carbonates, to form the corresponding iron and manganese oxides, and carbon dioxide, which can then be passed overhead to the recycle stream 36.

The solid manganese and iron oxides can then be further processed to form commercial ferromanganese, by well-known reduction processes. The leach liquid, substantially free of iron and manganese, in the nickel, cobalt, copper recovery stage 32, is then treated, for example by liquid ion exchange extraction, so as to remove the nickel, copper and cobalt values, and thus regenerate the ammonium salt solution, which is passed through recycle stream 35 and reused in the leaching stage 12. As required, make-up ammonia 37 and make-up $CO_2$ 39 can be added to the recycle stream 35, as required, in addition to the recycled ammonia and carbon dioxide from the respective recycle lines 31 and 36.

The nickel, copper and cobalt can be separated from the leach liquid in the recovery stage 32, by the liquid ion exchange extraction procedures described above: the nickel and copper are selectively extracted utilizing one of the aforesaid liquid ion exchange reagents, leaving an aqueous raffinate containing the dissolved cobalt value, which can then be removed by, for example, sulfide precipitation, regenerating the substantially pure ammonium salt/ammonia releaching liquid. The separated nickel salts, copper salts and cobalt salts can then be further treated as desired, to, for example, form the pure metals.

In the example shown, the leach stage 12 utilizes an ammonium carbonate/ammonia leaching solution.

It has been recognized that the manganese nodule ore contains a variety of soluble metals values, especially including the alkali and alkaline earth metals, such as sodium and potassiaum, and magnesium. In order to prevent the build-up of such materials in the leaching liquid, a minor portion of the leaching liquid passing through the recycle conduit 35 is removed through bleed stream 23 and passed to a salt removal stage 20, wherein the bleed stream is evaporated and the salts therein obtained and dried. The dried salts are continued to be heated until the ammonium salt is decomposed and passes off overhead through an ammonium salt conduit 25 from which it is condensed and remixed into the recycle conduit 35. As needed, additional makeup ammonium salt can be fed into the recycle stream 35.

The following examples include preferred embodiments of the procedures carried out in accordance with the process of the present invention. The various process steps set forth in the following working examples, and in the aforedescribed drawing, are intended to be merely exemplary of the present invention and do not limit the scope thereof, which encompasses procedures as broadly defined above and all equivalents thereof.

EXAMPLE 1

A sample of an ocean floor nodule ore (containing 15.2% manganese, 10.2% iron, 0.54% nickel, 0.28% cobalt, and 0.09% copper), had been ground to a particle size of not greater than about 100 mesh U.S. Sieve Scale. A sample of the ore (50 gm) is placed into a 2.5 inches Vycor tube and placed into a furnace. The tube and the contents are initially purged with nitrogen at a rate of 150cc/minute while the furnace is being heated to a temperature of about 350° C. When the operating temperature is reached, the nitrogen purge is closed off and the kiln was manually rotated 180° and back every five minutes while 300ml/minute STP of reformer gas (25–30 volume % CO, 15–20 vol. % $H_2$ and 50–55 vol. % $N_2$) was injected into the tube for a total time of 75 minutes.

Following completion of the reduction reaction, the reduced ore was cooled and discharged into a 200 milliliter centrifuge bottle containing 175 ml ammonium carbamate solution (260 grams/liter $NH_3$ - 150 grams/liter $CO_2$), and air bubbled through the solution; the bottle was then stoppered and rotated for 1 hour at 25° C. Following subsequent centrifugation, the supernatant liquid was quickly decanted into a sample bottle which was then capped. The remaining solids were then admixed with 150 milliliters of additional fresh ammonium carbamate solution, rotated for an additional hour at 25° C., centrifuged and the supernatant liquid decanted. The two supernatant liquids were combined and the combined solution analyzed for dissolved metal values.

A second sample of the dried and ground ore, but without reduction, is treated with the ammonium carbamate solutions in the same manner as described above. The ammonium carbamate solutions are combined and analyzed for dissolved metal values.

The combined liquid solution obtained from the reduced ore material contained the following percentages of the metal values present in the leached ore: manganese - 73.1% by weight, iron - 4.2% by weight, nickel - 66.7% by weight, cobalt - 66% by weight and copper, 84.6% by weight. The supernatant leach liquid obtained from the non-reduced ore was found to contain substantially no metal values, other than the undesirable alkali and alkaline earth metals. Accordingly, it has been shown that the reduction of the ore is necessary before any substantial leaching of the metal values can be obtained utilizing an ammoniated leach solution.

The pregnant leach solution is spraged by bubbling air therethrough, at a temperature of 75° C., for 1 hour at a rate of 100 ml./min. The clear liquid is separated from the resultant precipitate by filtration and the liquid is reanalyzed. Substantially all of the manganese and iron have been removed.

EXAMPLE 2

An ammoniacal carbonate solution, of the type obtained by the leaching of a reduced manganese nodule ore, was prepared by forming a leaching solution by admixing 150 ml. concentrated $NH_4OH$ to give a total volume of 250 ml. This dilute ammonium hydroxide solution was mixed with 250 grams of ammonium carbonate, and the resulting solution contacted with a mixture of copper, nickel and cobalt metals to give a solution containing 7500ppm copper, 6250ppm nickel and 600ppm cobalt. The solution after the leaching had a pH of 9.4. The solution was next subjected to liquid ion exchange in accordance with this process to obtain a separation of the three metal values.

The liquid ion exchange solution was an organic, water-insoluble solution comprising 5% by volume of a 7-hydrocarbon-substituted-8-hydroxyquinoline (Kelex 100), 5% isodecanol and 90% aromatic hydrocarbon solvent (Napoleum 470).

The leach solution prepared above was contacted with an equal volume of the above-described organic liquid ion exchange solution in a mixing vessel. The mixed liquids were then permitted to settle and the upper, organic layer decanted. The lower aqueous solution, raffinate, was then contacted with a second equal volume of fresh liquid ion exchange solution according to the same procedure as above and again the organic and aqueous layers were separated. A third contact, with fresh, organic, liquid ion exchange solution, was made with the aqueous raffinate from the second contact. The aqueous raffinate after each of the three contacts were analyzed and the amounts of copper, nickel and cobalt values remaining therein were determined and are set forth in the following table:

Table I

| | Copper (ppm) | Nickel (ppm) | Cobalt (ppm) |
|---|---|---|---|
| Feed solution | 7,500 | 6,250 | 600 |
| After 1st Contact | 4,000 | 6,000 | 600 |
| After 2nd Contact | 900 | 5,850 | 600 |
| After 3rd Contact | 0 | 3,250 | 600 |

As shown from the above table, the copper can first be readily separated from the nickel and cobalt, and in a subsequent series of contacts nickel can be readily separated from the cobalt leaving the cobalt substantially undisturbed in the aqueous final raffinate. The nickel can be stripped from the organic liquid ion exchange solution by a weak acid solution, for example having a pH of about 2.

The patentable embodiments of the invention which are claimed are as follows:

1. A process for removing the metal values from a manganese nodule ore, the ore comprising a primary proportion of manganese and iron and secondary proportions of nickel, copper and cobalt, the weight ratio of manganese:iron being at least about 5:1 and the total combined amounts of copper, cobalt and nickel being at least about 1.5% by weight of the nodule are, the process comprising:

(a) comminuting the ore to a particle size of not greater than about 20 mesh;

(b) reducing the comminuted ore at a temperature in the range of from about 300° to about 850° C., in the presence of a reducing agent selected from the group consisting of carbonaceous materials and hydrogen, such that substantially all of the manganese, nickel, cobalt and copper values and only a portion of the iron value are reduced to a condition in which the metal values are leachable by ammoniacal ammonium salt solutions with oxidation;

(c) leaching the reduced ore with an ammoniacal aqueous leaching solution of an ammonium salt wherein the total concentration of total ammonium ion is at least about 260 grams/liter, the concentration of ammonium hydroxide in the leaching solution being at least about 120 grams/liter, as ammonium ion, and wherein the concentration of the ammonium salt anion is at least about 0.83 Normal to form an aqueous pregnant leach solution comprising the soluble manganese, iron, nickel, copper and cobalt salts and at least a major amount of the ammonium hydroxide generated during the leaching step, and a solid residue, the ore and the leach solution being oxidized prior to completion of the leaching, the ratio of iron-to-manganese in the solution being less than that in the ore;

(d) treating the pregnant leach solution to remove sufficient ammonia to obtain the precipitation of substantially all of the iron and manganese values from the pregnant leach solution without substantial precipitation of any nickel, cobalt and copper to form a substantially manganese-and-iron-free pregnant leach solution and solid manganese and iron compounds; and (e) separating the nickel, cobalt and copper values from the manganese-and-iron-free pregnant leach solution so as to regenerate the ammoniated ammonium salt leaching solution.

2. The process of claim 1 wherein the amount of ammonium salt in the leaching solution is at least about substantially the stoichiometric amount required to react with all of the manganese and iron in the ore.

3. The process of claim 2, wherein the ammonium salt is selected from the group consisting of ammonium sulfate, ammonium chloride, and ammonium nitrate.

4. The process of claim 2, wherein the leaching solution comprises dissolved ammonium carbonate.

5. The process of claim 1, wherein the reduced ore is simultaneously aerated and leached.

6. The process of claim 1, wherein the nodule ore is reduced at a temperature in the range of from about 300° to about 850° C.

7. The process of claim 6, comprising in addition drying the nodule ore prior to reduction.

8. The process of claim 7, wherein the nodule ore is dried at a temperature in the range of from about 150° to about 250° C.

9. The process of claim 6, wherein the nodule ore is reduced by being reacted with a reducing agent selected from the group consisting of a carbonaceous reducing agent and a hydrogen-containing reducing agent.

10. The process of claim 9, wherein the carbonaceous reducing agent is selected from the group consisting of carbon, hydrocarbon compounds and carbon monoxide.

11. The process of claim 1, wherein the regenerated ammoniated ammonium salt leaching solution is recycled and used to leach additional reduced ore.

12. The process of claim 1, wherein the ammonium salt is ammonium carbonate and manganese carbonate and iron carbonate are precipitated, and further comprising thermally decomposing the manganese and iron salts so as to form manganese and iron oxides and carbon dioxide, and contacting the carbon dioxide and ammonia with the ammoniated aqueous solution to form the ammonium carbonate leaching solution and recycling to contact reduced nodule ore.

13. The process of claim 12, wherein the manganese and iron are precipitated by sparging the pregnant leach solution with an inert gas to remove the ammonia.

14. The process of claim 1, comprising contacting the leach solution with an organic water-immiscible, liquid ion exchange extracting medium comprising an extracting agent selected from the group consisting of alpha-hydroxyoximes and 7-hydrocarbon-substituted-8-hydroxyquinolines so as to selectively extract copper, forming an organic phase containing the copper value, substantially free of cobalt and nickel values, and connecting the first raffinate with a second organic, water-immiscible, liquid ion exchange medium comprising an extracting agent selected from the aforesaid group so as to selectively extract nickel, forming a second organic phase containing the nickel value and a second aqueous raffinate containing the cobalt value.

15. The process of claim 14, wherein the pH of the leach solution is at least about 9.

16. The process of claim 15, wherein the pH of the leach solution is in the range of from about 9 to about 10.

* * * * *

UNITED STATES PATENT AND TRADEMARK OFFICE

CERTIFICATE OF CORRECTION

PATENT NO. : 4,093,698

DATED : June 6, 1978

INVENTOR(S) : Paul H. Cardwell, William S. Kane

It is certified that error appears in the above-identified patent and that said Letters Patent are hereby corrected as shown below:

Column 11, line 51, "are" should read --ore--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*